US009074474B2

(12) United States Patent
Maier et al.

(10) Patent No.: US 9,074,474 B2
(45) Date of Patent: Jul. 7, 2015

(54) PUMP, IN PARTICULAR A HIGH-PRESSURE FUEL PUMP

(75) Inventors: Eberhard Maier, Koengen (DE); Markus Schetter, Plochingen (DE)

(73) Assignee: Robert Bosch GmbH, Stuttgart (DE)

( * ) Notice: Subject to any disclaimer, the term of this patent is extended or adjusted under 35 U.S.C. 154(b) by 406 days.

(21) Appl. No.: 13/805,128

(22) PCT Filed: May 24, 2011

(86) PCT No.: PCT/EP2011/058397
§ 371 (c)(1),
(2), (4) Date: Dec. 18, 2012

(87) PCT Pub. No.: WO2011/160908
PCT Pub. Date: Dec. 29, 2011

(65) Prior Publication Data

US 2013/0104730 A1 May 2, 2013

(30) Foreign Application Priority Data

Jun. 24, 2010 (DE) ..... 10 2010 030 498

(51) Int. Cl.
*F02M 59/10* (2006.01)
*F01B 23/00* (2006.01)
*F02M 59/44* (2006.01)
(Continued)

(52) U.S. Cl.
CPC ..... *F01B 23/00* (2013.01); *F02M 59/102* (2013.01); *F02M 59/44* (2013.01); *F02M 63/0001* (2013.01); *F04B 1/0408* (2013.01);
(Continued)

(58) Field of Classification Search
CPC . F02M 59/102; F02M 59/44; F02M 63/0001; F04B 1/0426; F04B 53/18; F04B 53/20
See application file for complete search history.

(56) References Cited

U.S. PATENT DOCUMENTS 5,280,746 A 1/1994 Siegel
5,775,203 A 7/1998 Osborn et al.
(Continued)

FOREIGN PATENT DOCUMENTS

DE 3236536 A1 4/1984
DE 10115168 8/2002
(Continued)

OTHER PUBLICATIONS

PCT/EP2011/058397 International Search Report dated Jul. 1, 2011 (Translation and Original, 6 pages).

*Primary Examiner* — Thomas E Lazo
(74) *Attorney, Agent, or Firm* — Michael Best & Friedrich LLP

(57) ABSTRACT

The pump comprises at least one pump element which has a pump piston that is at least indirectly driven in a stroke movement by a drive shaft. A plunger having a plunger body is arranged between the drive shaft and the pump piston and is movably guided in a receiving device in the direction of the stroke movement of the pump piston and is supported on the drive shaft by means of a support element. Lubricant is supplied to the receiving device via a supply line and lubricant is conducted out of the receiving device via a discharge line into the plunger body to the support element. An annular gap filter is provided between the plunger body and the receiving device and is arranged between the supply line for supplying lubricant to the receiving device and the discharge line for discharging lubricant into the plunger body.

7 Claims, 3 Drawing Sheets

(51) Int. Cl.

| | |
|---|---|
| ***F02M 63/00*** | (2006.01) |
| ***F04B 1/04*** | (2006.01) |
| ***F04B 53/18*** | (2006.01) |
| ***F04B 53/20*** | (2006.01) |

(52) U.S. Cl.
CPC ..... *F04B1/0426* (2013.01); *F04B 53/18* (2013.01); *F04B 53/20* (2013.01)

(56) References Cited

U.S. PATENT DOCUMENTS

| | | | | |
|---|---|---|---|---|
| 6,216,583 | B1 * | 4/2001 | Klinger et al. | 92/129 |
| 6,217,299 | B1 * | 4/2001 | Jay | 417/470 |
| 6,224,352 | B1 | 5/2001 | Hauser et al. | |
| 6,837,694 | B2 | 1/2005 | Furuya et al. | |
| 7,308,849 | B2 | 12/2007 | Schoetz et al. | |
| 7,748,359 | B2 * | 7/2010 | Bartley et al. | 123/90.48 |
| 2008/0006233 | A1 | 1/2008 | Bartley et al. | |

FOREIGN PATENT DOCUMENTS

| | | |
|---|---|---|
| DE | 102006031032 | 1/2008 |
| JP | 58-62111 | 4/1983 |

* cited by examiner

PUMP, IN PARTICULAR A HIGH-PRESSURE FUEL PUMP

BACKGROUND OF THE INVENTION

The invention proceeds from a pump, in particular a high-pressure fuel pump.

Such a pump in the form of a high-pressure fuel pump is known from DE 101 15 168 C1. This pump comprises at least one pump element which has a pump piston driven in a lifting movement at least indirectly by a drive shaft. A tappet with a tappet body is arranged between the drive shaft and the pump piston and is guided displaceably in the direction of the lifting movement of the pump piston in a receptacle and is supported on the drive shaft via a supporting element in the form of a roller. Lubricant is fed into the receptacle for the tappet body via a feed line and lubricant is conducted out of the receptacle via a discharge line into the tappet body to the supporting element, in order to ensure lubrication between the supporting element and tappet body. When the tappet body and/or the receptacle or other components of the pump or internal combustion engine experience wear, the lubricant may contain particles which may then also infiltrate between the supporting element and the tappet body and cause increased wear there. If the discharge line in the tappet body has a small throughflow cross section, the risk furthermore exists that the discharge line may be blocked by particles, and therefore sufficient lubrication of the supporting element is no longer ensured.

DISCLOSURE OF THE INVENTION

SUMMARY OF THE INVENTION

The pump according to the invention has, by contrast, the advantage that the possible ingress of particles between the supporting element and the tappet body is prevented or at least reduced by the annular-gap filter and therefore the wear of the pump is reduced.

BRIEF DESCRIPTION OF THE DRAWINGS

An exemplary embodiment of the invention is illustrated in the drawing and is explained in more detail in the following description.

DETAILED DESCRIPTION

Figure 1:
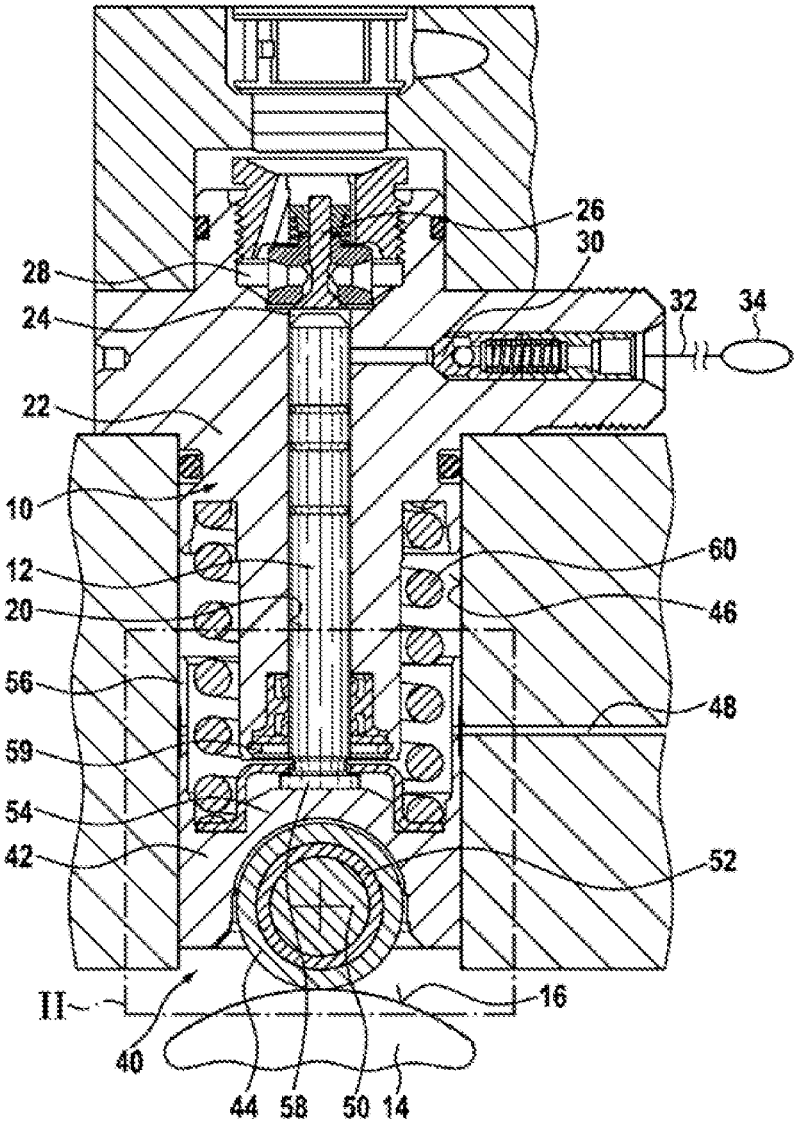
FIG. 1 shows a pump in a longitudinal section.
Figure 2:
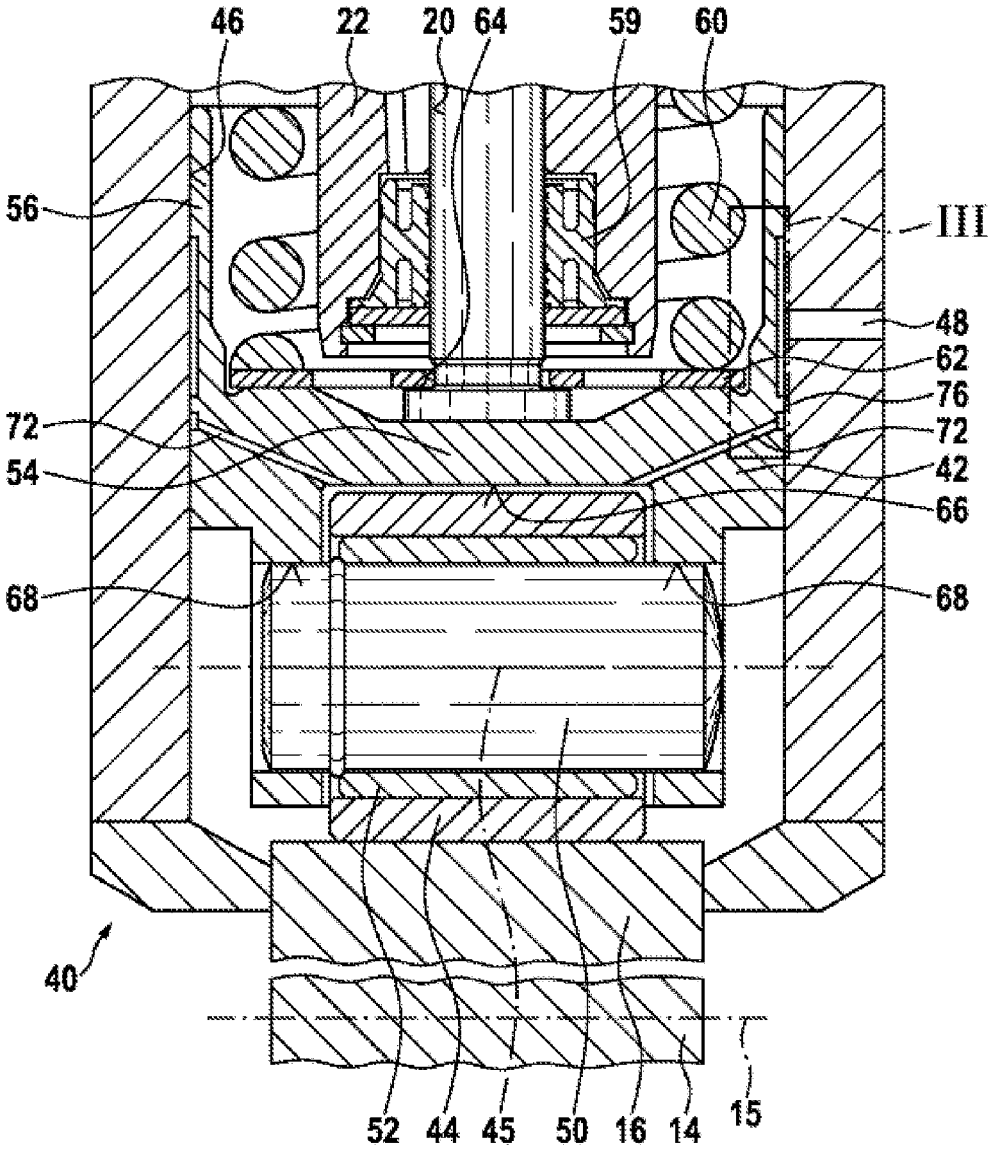
FIG. 2 shows a detail, designated by II in FIG. 1, of the pump in an enlarged illustration.
Figure 3:
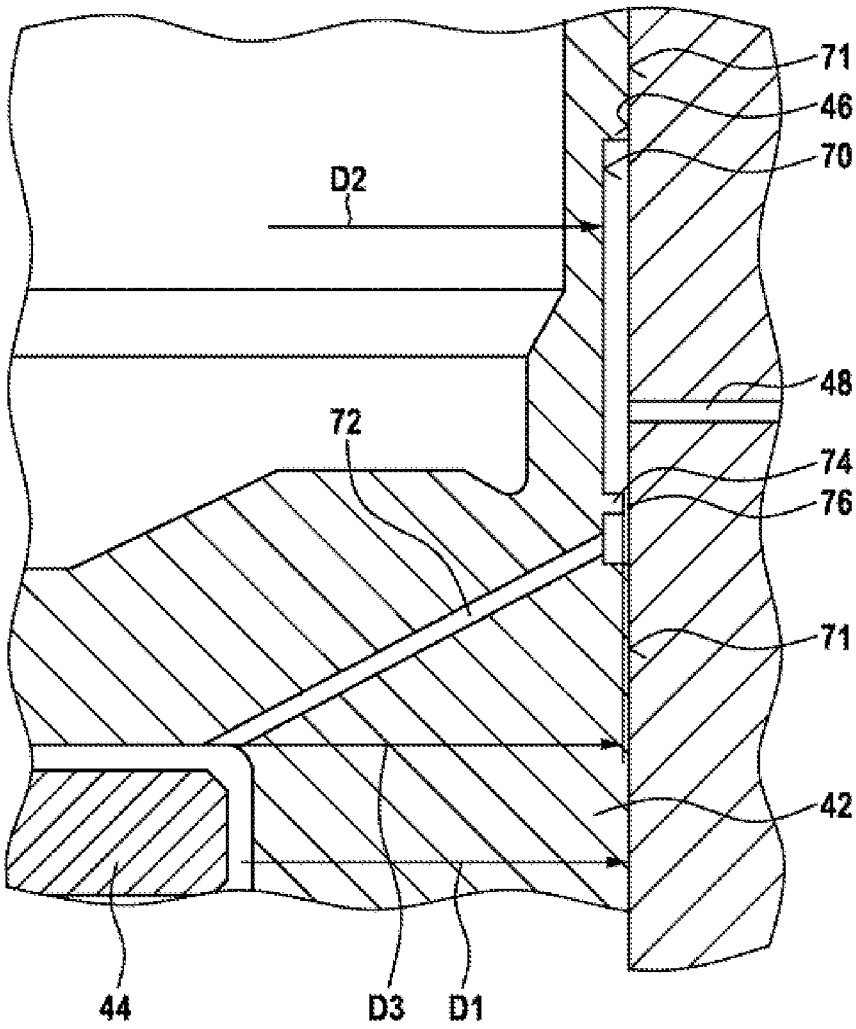
FIG. 3 shows a further-enlarged detail III from FIG. 2.

FIGS. 1 to 3 illustrate a pump which is, in particular, a high-pressure fuel pump for a fuel injection system of an internal combustion engine. The pump has at least one pump element 10 which in turn has a pump piston 12 which is driven in a lifting movement at least indirectly by a drive shaft 14 in an at least approximately radial direction with respect to the axis of rotation 15 of the drive shaft 14. The drive shaft 14 may be part of the pump, or alternatively there may also be provision whereby the pump has no dedicated drive shaft and the drive shaft 14 is part of the internal combustion engine. The drive shaft 14 may in this case be, for example, a shaft of the internal combustion engine by means of which the gas exchange valves of the internal combustion engine are also actuated. The drive shaft 14 may have a cam 16 or eccentric for driving the pump piston 12.

The pump piston 12 is guided sealingly in a cylinder bore 20 of a housing part 22 of the pump. The pump piston 12, with its end facing away from the drive shaft 14, delimits a pump working space 24 in the cylinder bore 20. The pump working space 24 has, via an inlet nonreturn valve 26 opening into the latter, a connection to an inflow 28 which comes, for example, from a feed pump and via which the pump working space 24 is filled with fuel when the pump piston 12 executes a suction stroke directed radially inward with respect to the axis of rotation 15 of the drive shaft 14. Moreover, the pump working space 24 has, via an outlet nonreturn valve 30 opening out of the latter, a connection to an outflow 32 which leads, for example, to a high-pressure fuel accumulator 34 and via which fuel is displaced out of the pump working space 24 when the pump piston 12 executes a feed stroke directed radially outward away from the axis of rotation 15 of the drive shaft 14.

The pump piston 12 is supported on the cam 16 of the drive shaft 14 indirectly via a tappet 40. The tappet 40 comprises a tappet body 42 in which is arranged a supporting element 44 which is preferably designed in the form of a roller. The tappet body 42 has an at least essentially circular-cylindrical outer contour and is guided displaceably in the direction of the lifting movement of the pump piston 12 in a receptacle 46. The receptacle 46 may be designed in the form of a bore which is introduced in a housing part of the pump or in a housing part of the internal combustion engine. A feed line 48 for lubricant, which is designed, for example, in the form of at least one bore, issues into the receptacle 46. Lubricant is fed via the feed line 48 into the receptacle 46 for lubrication between the tappet body 42 and the receptacle. Fuel or lubricating oil of the internal combustion engine may serve as lubricant.

The supporting element 44 may be directly mounted rotatably in the tappet body 42 or in a carrier element, for example a roller shoe, inserted into the tappet body 42. In the exemplary embodiment illustrated, the supporting element 44 is designed in the form of a cylindrical roller which is mounted rotatably in the tappet body 42 via a bolt 50. The axis of rotation 45 of the roller 44 runs in this case at least approximately parallel to the axis of rotation 15 of the drive shaft 14. The roller 44 is of hollow form and, where appropriate, is mounted on the bolt 50 via a bearing bush 52. The tappet body 42 has, in its end region facing the drive shaft 14, a bottom region 54 and, adjoining the latter away from the drive shaft 14, a jacket region 56. The jacket region 56 is of at least essentially hollow-cylindrical form, and the pump piston 12 projects into this with its end region emerging from the cylinder bore 20. The pump piston 12 may have in its end region projecting out of the cylinder bore 20 a piston foot 58 which is enlarged in diameter in relation to the cylinder bore 20 and which bears against the bottom region 54 of the tappet body 42. A sealing element 59 may be tension-mounted between the pump piston 12 and the housing part 22, as is provided especially when the lubricant used for the tappet body 42 in the receptacle 46 is lubricating oil from the internal combustion engine. The sealing element 59 serves for preventing intermixing of lubricating oil and fuel or for at least keeping this intermixing as low as possible.

Between the tappet body 42 and a fixed support, for example the housing part 22 of the pump or a housing part of the internal combustion engine, is arranged a prestressed spring 60 by means of which the tappet body 42 is pressed toward the drive shaft 14. The spring 60 is designed, for example, as a helical compression spring and projects into the jacket region 56 of the tappet body 42. The spring 60 surrounds the pump piston 12 approximately coaxially and bears via a spring plate 62 against the radially outer margin of the bottom region 54 of the tappet body 42. The spring plate 62 is of disk-shaped form and has in its central region an orifice 64, the diameter of which is somewhat larger than the diameter of the shank, arranged in the cylinder bore 20, of the pump piston 12 and smaller than the diameter of the piston foot 58 of the pump piston 12. The spring plate 62 is thus supported in its central region on the piston foot 58 of the pump piston 12 and keeps the latter in bearing contact against the bottom region 54 of the tappet body 42. Thus, by means of the spring 60, the tappet body 42 and the pump piston 12 are pressed toward the drive shaft 12. An antitwist device for the tappet body 42 may be provided, which prevents the tappet body 42 from being able to twist about its longitudinal axis in the receptacle. Such an antitwist device may be formed, for example, in a known way by a pin which is arranged in the receptacle 46 and which engages into a recess in the outer jacket of the tappet body.

The tappet body 42 has in its bottom region 54, on its side facing the drive shaft 12, a recess 66 for the roller 44, and the bolt 50 on which the roller 44 is mounted is mounted in bores 68 in the walls of the bottom region 54 of the tappet body 42 which laterally delimit the recess. Alternatively, there may also be provision whereby the bolt 50 is dispensed with and the roller 44 is mounted directly via its outer jacket in the recess 66 designed as a half shell.

The tappet body 42 has in its outer jacket an annular groove 70 which extends in the axial direction, for example starting from the bottom region 54, into the jacket region 56 of the tappet body 42. The annular groove 70 is arranged in the axial direction such that it is in overlap with the issue of the feed line 48 of the lubricant into the receptacle 46 constantly, that is to say throughout the entire lifting movement of the tappet body 42 and therefore of the pump piston 12. A discharge line 72 for lubricant leads from the annular groove 70 through the tappet body 42 into the recess 66. The discharge line 72 may be formed by at least one bore, although a plurality of bores, in particular two bores lying diametrically opposite one another, may also be provided, which in each case issue into the recess 66 in the region of the axial ends of the roller 44. Lubricant is thus fed via the discharge line 72 to the mounting of the roller 44 in the tappet body 42.

The tappet body 42 has on both sides of its annular groove 70 guide portions 71, by which the tappet body 42 is guided with slight radial play in the receptacle 46 and which have a diameter D1, the diameter of the tappet body 42 in the region of the annular groove 70 being designated by D2.

According to the invention, a radial web 74 or collar is arranged in the annular groove 70 and has a larger diameter D3 than the annular groove 70, although the diameter D3 is only a little smaller than the diameter D1. The web 74, together with the receptacle 46 surrounding it, forms an annular-gap filter 76 for the lubricant flowing via the discharge line 72 into the tappet body 42 for the purpose of lubricating the roller 44. The web 74 is arranged near the issue of the discharge line 72 on the tappet body 42 in the annular groove 70, as seen in the axial direction of said tappet body 42. Throughout the entire lifting movement of the tappet body 42, that part of the annular groove 70 which is not connected to the discharge line 72 is in overlap with the feed line 48, and that part of the annular groove 70 which is connected to the discharge line 72 does not come into overlap with the feed line 48.

The difference between the diameter D1 of the guide portions 71 of the tappet body 42 and the diameter D3 of the web 74 is determined such that, on the one hand, a sufficiently large throughflow cross section for the lubricant is present and, on the other hand, particles are retained from the lubricant to a sufficient extent, so that they cannot infiltrate into the discharge line 72 and into the tappet body 42.

The invention claimed is:

1. A pump with at least one pump element (10) which has a pump piston (12) driven in a lifting movement at least indirectly by a drive shaft (14), a tappet (40) with a tappet body (42) being arranged between the drive shaft (14) and the pump piston (12) and being guided displaceably in a direction of the lifting movement of the pump piston (12) in a receptacle (46) and being supported on the drive shaft (14) via a supporting element (44), lubricant being fed into the receptacle (46) via a feed line (48) and lubricant being conducted out of the receptacle (46) via a discharge line (72) into the tappet body (42) to the supporting element (44), characterized in that an annular-gap filter (76) is provided between the tappet body (42) and the receptacle (46) and is arranged between the feed line (48) of lubricant into the receptacle (46) and the discharge line (72) of lubricant into the tappet body (42).

2. The pump as claimed in claim 1, characterized in that the tappet body (42) has in its outer jacket an annular groove (70) which is connected constantly to the feed line (48) for lubricant into the receptacle (46) and to the discharge line (72) of lubricant into the tappet body (42), and in that a peripheral web (74) projecting in relation to the annular groove (70) in a radial direction with respect to the tappet body (42) is provided in said annular groove for the purpose of forming the annular-gap filter (76).

3. The pump as claimed in claim 2, characterized in that a radial extent (D3) of the web (74) in the radial direction with respect to the tappet body (42) is only a little smaller than a radial extent (D1) of a guide region (71) of the tappet body (42) via which the latter is guided in the receptacle (46).

4. The pump as claimed in claim 3, characterized in that a throughflow cross section of the annular-gap filter (76) is larger than a throughflow cross section of the discharge line (72) in the tappet body (42).

5. The pump as claimed in claim 2, characterized in that a throughflow cross section of the annular-gap filter (76) is larger than a throughflow cross section of the discharge line (72) in the tappet body (42).

6. The pump as claimed in claim 1, characterized in that a throughflow cross section of the annular-gap filter (76) is larger than a throughflow cross section of the discharge line (72) in the tappet body (42).

7. The pump as claimed in claim 1, characterized in that the pump is a high pressure fuel pump.

* * * * *